US010170829B2

(12) United States Patent
Le Roy-Naneix et al.

(10) Patent No.: US 10,170,829 B2
(45) Date of Patent: Jan. 1, 2019

(54) SELF-COMPLEMENTARY MULTILAYER ARRAY ANTENNA

(71) Applicant: THALES, Courbevoie (FR)

(72) Inventors: Isabelle Le Roy-Naneix, Elancourt (FR); Gwenaël Morvan, Elancourt (FR); Michèle Labeyrie, Elancourt (FR); Bernard Perpere, Elancourt (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 15/526,753

(22) PCT Filed: Nov. 26, 2015

(86) PCT No.: PCT/EP2015/077766
§ 371 (c)(1),
(2) Date: May 13, 2017

(87) PCT Pub. No.: WO2016/087304
PCT Pub. Date: Jun. 9, 2016

(65) Prior Publication Data

US 2017/0338553 A1 Nov. 23, 2017

(30) Foreign Application Priority Data

Dec. 5, 2014 (FR) ..... 14 02780

(51) Int. Cl.
*H01Q 1/50* (2006.01)
*H01Q 1/52* (2006.01)
(Continued)

(52) U.S. Cl.
CPC ..... *H01Q 1/523* (2013.01); *H01Q 5/307* (2015.01); *H01Q 9/0421* (2013.01);
(Continued)

(58) Field of Classification Search
CPC ... H01Q 9/0421; H01Q 21/062; H01Q 21/065
(Continued)

(56) References Cited

U.S. PATENT DOCUMENTS 6,114,997 A * 9/2000 Lee ..... H01Q 1/38 343/700 MS
7,154,451 B1 * 12/2006 Sievenpiper ..... H01Q 1/248 343/909

(Continued)

FOREIGN PATENT DOCUMENTS

WO 2012/003546 A1 1/2012

OTHER PUBLICATIONS

John T. Logan et al., "Planar Ultrawideband Modular Antenna (PUMA) arrays scalable to mm-waves," 2013 IEEE Antennas and Propagation Society International Symposium, Jul. 7, 2013, pp. 624-625, XP032555710.

(Continued)

*Primary Examiner* — Huedung X Mancuso
(74) *Attorney, Agent, or Firm* — Baker & Hostetler LLP

(57) ABSTRACT

An antenna array including a radiating structure formed from an array of radiating elements forming self-complementary patterns, the radiating surface separated from a ground plane by a dielectric layer, the antenna comprises an array of metallized vias passing through the dielectric layer between the radiating surface and the ground plane, each via being positioned facing a given point, referred to as the particular point, of a radiating element. The particular points may be located between two consecutive electrical supply points of a radiating element.

7 Claims, 5 Drawing Sheets

(51) Int. Cl.

| | |
|---|---|
| ***H01Q 9/04*** | (2006.01) |
| ***H01Q 9/06*** | (2006.01) |
| ***H01Q 9/28*** | (2006.01) |
| ***H01Q 21/06*** | (2006.01) |
| ***H01Q 21/24*** | (2006.01) |
| ***H01Q 5/307*** | (2015.01) |
| *H01Q 1/38* | (2006.01) |
| *H01Q 1/42* | (2006.01) |

(52) U.S. Cl.
CPC ..... *H01Q 9/065* (2013.01); *H01Q 9/285* (2013.01); *H01Q 21/062* (2013.01); *H01Q 21/065* (2013.01); *H01Q 21/24* (2013.01); *H01Q 1/38* (2013.01); *H01Q 1/42* (2013.01)

(58) Field of Classification Search
USPC ..... 343/850
See application file for complete search history.

(56) References Cited

U.S. PATENT DOCUMENTS 7,456,803 B1* 11/2008 Sievenpiper ..... H01Q 15/02 343/700 MS
2010/0231464 A1* 9/2010 Huang ..... H01Q 1/38 343/702
2011/0057852 A1 3/2011 Holland et al.
2012/0146869 A1* 6/2012 Holland ..... H01P 5/10 343/795
2016/0322708 A1* 11/2016 Tayfeh Aligodarz ..... H01P 5/12
2018/0054006 A1* 2/2018 Wang ..... H01Q 21/24

OTHER PUBLICATIONS

De Lera Acedo et al., "Study and Design of a Differentially-Fed Tapered Slot Antenna Array," IEEE Transactions on Antennas and Propagation, vol. 58, No. 1, Jan. 1, 2010, pp. 68-78, XP011297193.
Steven Holland et al., "The Planar Ultrawideband Modular Antenna (PUMA) Array," IEEE Transactions on Antennas and Propagation, vol. 60, No. 1, Jan. 2012, pp. 130-140, XP011391336.
Andrea Neto et al., "Scanning Performances of Wide Band Connected Arrays in the Presence of a Backing Reflector," IEEE Transactions on Antennas and Propagation, vol. 57, No. 10, Oct. 2009, pp. 3092-3102.
D. Cavallo et al., "Analysis of Common-Mode Resonances in Arrays of Connected Dipoles and Possible Solutions," Proceedings of the 6th European Radar Conference, Sep. 30-Oct. 2, 2009, pp. 441-444.

* cited by examiner

SELF-COMPLEMENTARY MULTILAYER ARRAY ANTENNA

CROSS-REFERENCE TO RELATED APPLICATIONS

This application is a National Stage of International patent application PCT/EP2015/077766, filed on Nov. 26, 2015, which claims priority to foreign French patent application No. FR 1402780, filed on Dec. 5, 2014, the disclosures of which are incorporated by reference in their entirety.

FIELD OF THE INVENTION

The present invention relates to a self-complementary multilayer antenna array. It in particular is applicable to wideband multifunction antenna arrays.

BACKGROUND

There are various solutions for producing wideband arrays. These solutions use compatible radiating elements of brick architecture or of tile architecture.

In the brick architecture, the design of the radiating element is optimized by making the most of its thickness directly impacting the thickness of the array.

The wideband antenna arrays consist of Vivaldi arrays. These solutions have the drawback of being protrudent and bulky, in particular leading to a mechanical integration complexity.

Another wideband antenna solution is described in the document by A. Neto, D. Cavallo, G. Gerini and G. Toso, "Scanning Performances of Wide Band Connected Arrays in the Presence of a Backing Reflector", *IEEE Trans. Antennas Propag.*, vol. 57, no. 10, October 2009.

Another type of wideband antenna is further proposed in the document by D. Cavallo, A. Neto, G. Gerini: Analysis of Common-Mode Resonances in Arrays of Connected Dipoles and Possible Solutions—EUCAP 2009 and in the document by Steven S. Holland, Marinos N. Vouvakis—The Planar Ultrawideband Modular Antenna (PUMA) Array—IEEE TRANSACTIONS ON ANTENNAS AND PROPAGATION, VOL. 60, NO. 1, JANUARY 2012.

All these solutions have the drawback of being bulky and difficult to integrate into certain carriers.

In the context of tile architectures, one category of very wideband antenna array solutions have a radiating structure based on self-complementary patterns embedded in an encapsulation of dielectric layers, allowing the frequency band to be widened.

These multilayer structures have the advantage of having a small bulk, facilitating their integration into a carrier.

However, they have a drawback in the common-mode currents that may appear in this type of multilayer structure.

SUMMARY OF THE INVENTION

One aim of the invention is in particular to allow these common-mode currents to be suppressed in a multilayer antenna including a radiating structure based on self-complementary patterns.

To this end, the subject of the invention is a multilayer antenna array including a radiating structure formed from an array of radiating elements forming self-complementary patterns, said radiating surface being separated from a ground plane by a dielectric layer, said antenna including an array of metallized vias passing through said dielectric layer between the radiating surface and the ground plane, each via being positioned facing a given point, referred to as the particular point, of a radiating element.

In one possible embodiment, each radiating element includes a plurality of particular points, one via being formed facing each particular point.

One particular point is for example located between two consecutive electrical supply points of a radiating element, the particular point for example being located halfway between two consecutive electrical supply points.

In another possible embodiment, each radiating element includes four particular points, each point being located between two consecutive electrical supply points.

The vias are for example metallized holes produced in said layer.

In another possible embodiment, they take the form of pins.

The radiating structure is for example a printed circuit, the radiating elements being printed metal patches.

The radiating structure is for example covered with a dielectric layer, said layer being covered with a radome.

BRIEF DESCRIPTION OF THE DRAWINGS

Other features and advantages of the invention will become apparent from the following description which is given with reference to the appended drawings, which show.

DETAILED DESCRIPTION

Figure 1:
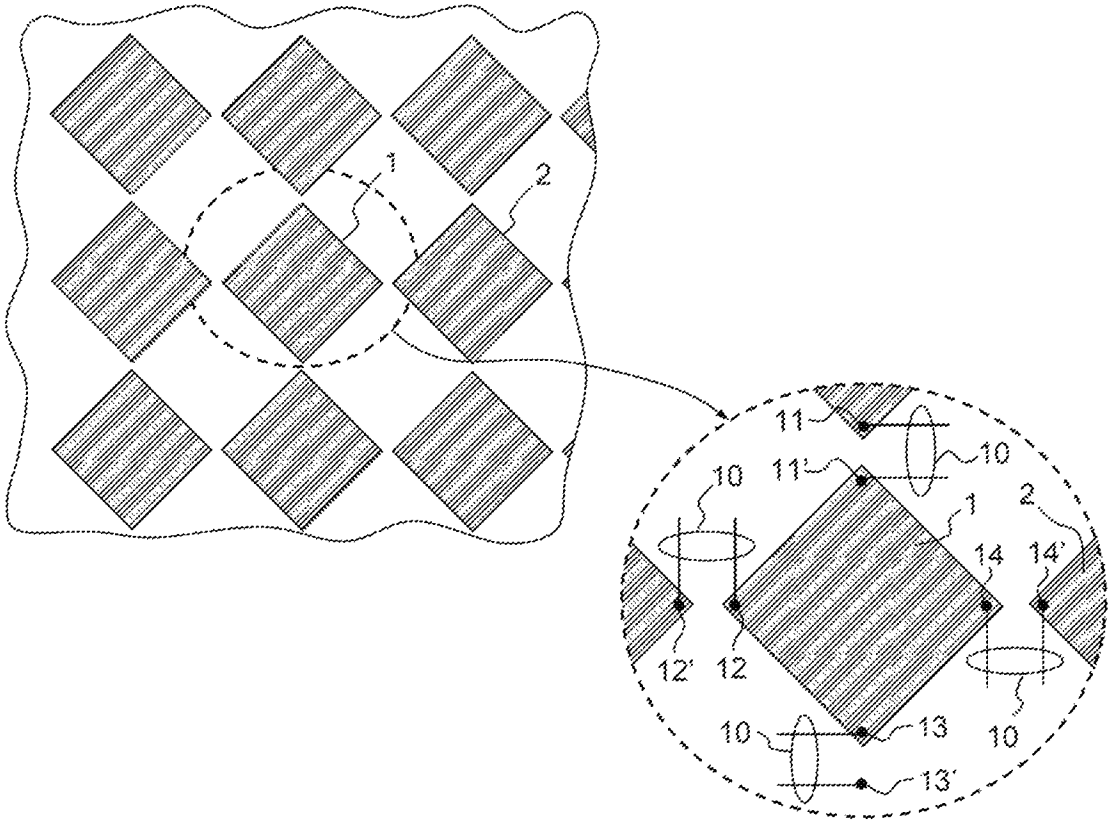
FIG. 1, an illustration of a radiating structure based on self-complementary features.

FIG. 1 shows by way of example a radiating structure based on self-complementary patterns via a partial view of an array. The patterns shown use printed metal patches 1, 2 of square shape, other shapes being possible. A self-complementary radiating structure is composed of an array of elementary features 1, 2 of dipole type, each of the two poles of which is a radiating element, a printed metal patch 1, 2 of square shape in the example in FIG. 1. Each feature is supplied by two-wire lines 10 the conductors of which are connected at the junction of the two patches of a dipole. For example a two-wire line 10 has its first branch connected to a supply point 14 of a patch and its second branch connected to a supply point 14' of the neighboring patch 2, the two points 14, 14' facing each other. Each patch 1, 2 therefore includes four supply points 11, 12, 13, 14, in order to achieve two orthogonal electromagnetic polarizations. The radiating structure is a printed circuit board, the metal patches 1, 2 being printed on the circuit board, the zones between the patches being nonmetallic.

As is known, since two-wire lines have a characteristic impedance of about 190 ohms, in order to obtain a match with the impedance of the dipoles (60π ohms, i.e. half the impedance of free space) they are connected to the other microwave frequency circuits by way of a balun in multilayer technology, here allowing on the one hand the impedance transformation between 50 ohms and 190 ohms and on the other hand conversion between balanced propagation and unbalanced propagation.

Figure 2:
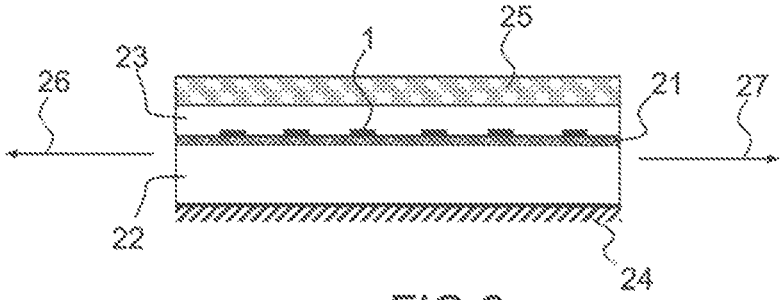
FIG. 2, via a cross-sectional view an antenna including a radiating structure according to FIG. 1.

FIG. 2 shows via a cross-sectional view an antenna including a radiating structure based on self-complementary features of the type shown in FIG. 1. More particularly, FIG. 2 shows the multilayer aspect of such an antenna. The multilayer structure is for example composed of at least one radiating structure 21 with the metal patches 1, insulating layers 22, 23 and a metal plane 24. A foam layer 22 is for example placed between the metal plane and the radiating structure 21. A foam layer 23 is for example placed above the radiating structure. This foam layer may be replaced by an air-filled space. The stack of layers 21, 22, 23, 24 is covered with a radome 25 that has an effect on the quality of the radiation.

All of the two-wire lines supplying the elementary features are not shown in this figure for the sake of readability. They for example pass through the layer 22 and the metal plane 24 in order to be connected to one or more control circuits, PCB control circuits for example.

Figure 3A:
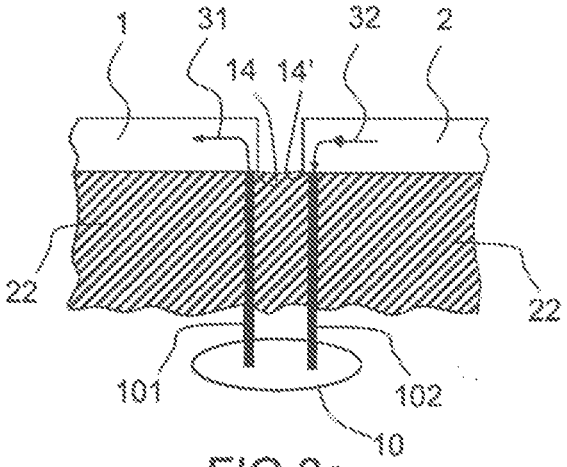
FIGS. 3*a* and 3*b*, an illustration of the common-mode resonance liable to occur in an antenna.
Figure 3B:
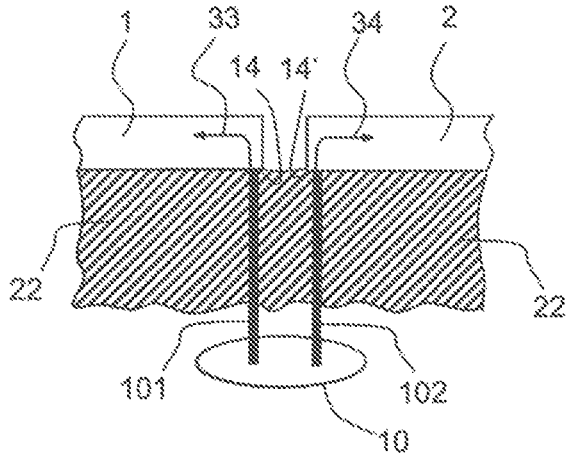

FIGS. 3*a* and 3*b* illustrate the common-mode currents specific to structures with self-complementary patterns. These figures show a view focused on two neighboring metal patches 1, 2 that are supplied by a two-wire line 10. More precisely, one patch 1 is supplied electrically at a point 14 by one branch 101 of the line 10 and the other patch 2 is supplied at a point 14' by the other branch 102 of the line. The latter passes through the insulator 22 supporting the patches, then passes through the other layers, which are not shown.

FIG. 3*a* shows the currents 31, 32 flowing through the patches, said currents being induced by the power supplied via the two-wire line 10. These currents move in the same direction, this corresponding to the case of ideal operation.

FIG. 3*b* illustrates the common-mode currents 33, 34 that are superposed on the preceding currents 31, 32. These common-mode currents are caused by electromagnetic coupling between the metal patches whilst they are being excited via their two-wire feeds. The common-mode currents 33, 34 are opposed. Their superposition on the nominal currents 31, 32 alters how the radiating structure 21 radiates.

Figure 4:
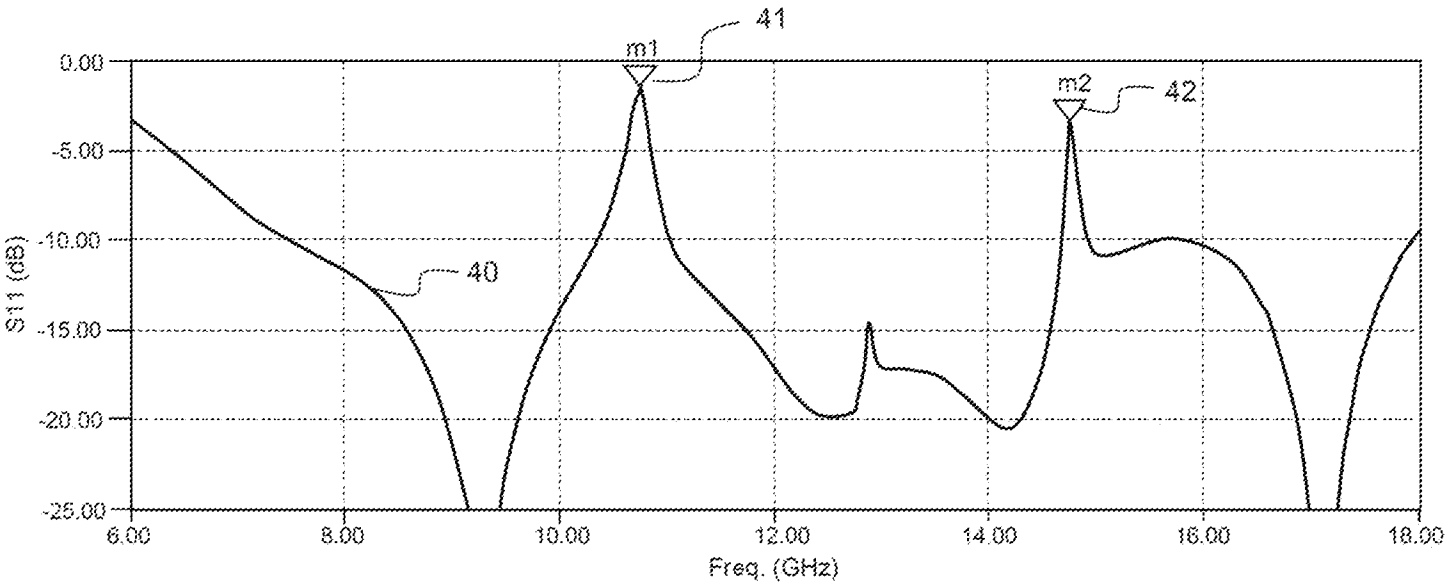
FIG. 4, a curve representative of the degradation of the reflection coefficient caused by the aforementioned effect.

FIG. 4 illustrates the effects of this common-mode resonance. More particularly, FIG. 4 illustrates with a curve 40 the value in dB of the reflection coefficient S11 as a function of frequency, between 6 GHz and 18 GHz. The coefficient S11 is related to the standing-wave ratio.

This common-mode resonance causes the reflection coefficient to increase to close to 1 at certain frequencies, as illustrated by the peaks 41, 42. The magnitude of the increase in the reflection coefficient and the corresponding frequencies depend in particular on the nature of the array, and in particular on the type of unit cell.

Analysis of the fields in the multilayer structure of the antenna moreover demonstrates the appearance of a field Ez, perpendicular to the surface, which propagates in the multilayer structure.

Figure 5:
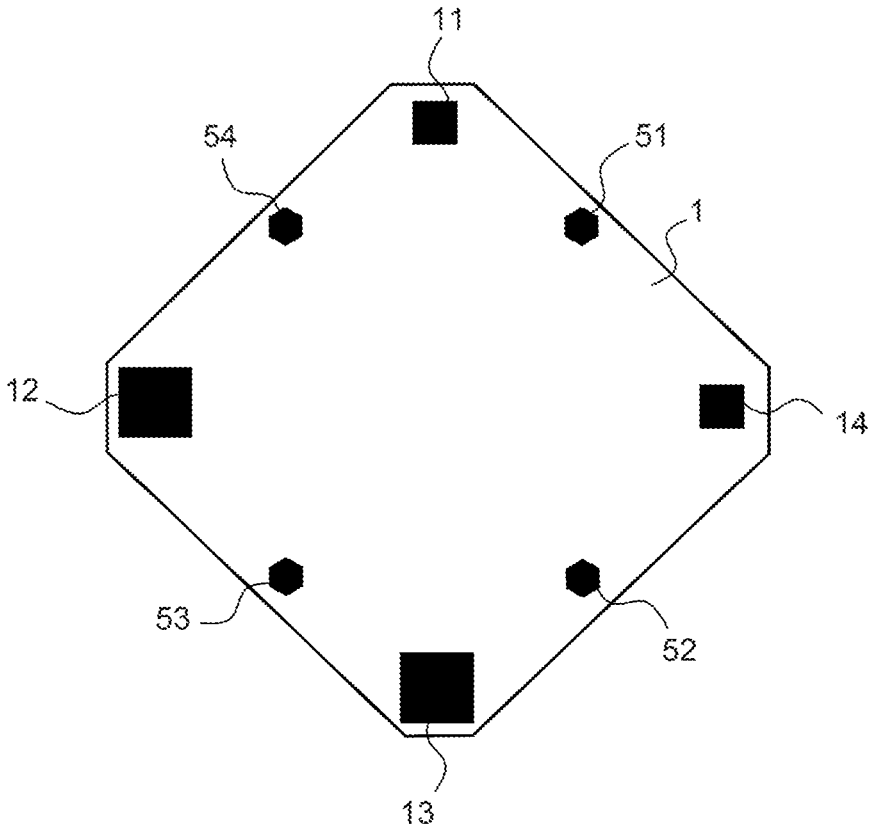
FIG. 5, one exemplary embodiment of an antenna according to the invention via a top view of a radiating element.

FIG. 5 illustrates the principle of the invention with an exemplary embodiment. According to the invention, metallized vias are inserted at given points 51, 52, 53, 54 into the layer 22 separating the radiating elements 1 and the ground plane, in order to decrease, or even eliminate, the coupling between the radiating elements causing the parasitic mode described above.

FIG. 5 illustrates the position of these given points, which will be referred to as particular points below. These particular points belong to the radiating elements, i.e. the vias are placed facing the radiating elements. FIG. 5 illustrates exemplary positions of the particular points for one metal patch, the positions being the same for all the other metal patches.

One advantageous position is located between the supply points 11, 12, 13, 14 outside of the central zone of the patch. One particularly advantageous position is located halfway between two points of the side of the patch as illustrated by FIG. 5. More generally, one particular point 54 is for example located between two consecutive supply points 11, 12. Two supply points 11, 12 of a radiating element 1 are consecutive if they follow one after the other on the perimeter of this element. In practice, if the shape of the element allows it, the particular points may be located on a straight line connecting two consecutive points, and in particular halfway therebetween, as illustrated by FIG. 5.

In the example in FIG. 5, the vias are placed at four points 51, 52, 53, 54 that are each located halfway between supply points of the patch.

The vias are thus produced facing each radiating element of the radiating surface 21.

Figure 6:
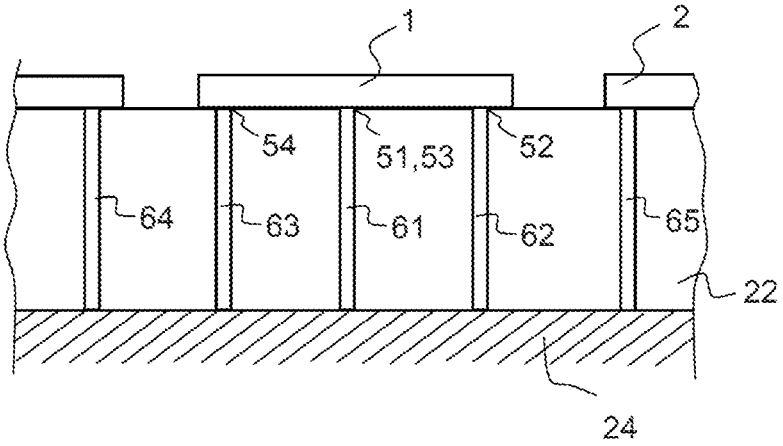
FIG. 6, one exemplary embodiment of an antenna according to the invention via a partial cross-sectional view.

FIG. 6 illustrates via a cross-sectional view, the vias 61, 62, 63 connecting one metal patch 1 and the ground plane, or metal plane 24. By producing these vias for each patch, a regular grid of vias 61, 62, 63, 64, 65 is obtained that partially or completely blocks the passage of common-mode currents.

Thus, an array of metallized vias passing through the layer 22 made of dielectric in a direction perpendicular to the radiating surface is obtained, the vias being positioned facing particular points 51, 52, 53, 54.

In the example in FIGS. 5 and 6, a single via is placed between the supply points. Where needs be, it is possible to place a plurality of vias between two supply points, in particular depending on the nature of the common mode.

In the case where the radiating elements do not take the form of square patches as illustrated in the figures, the particular points of insertion of the vias may be placed between the supply points of the radiating elements, outside of the central zone.

To produce the vias 61, 62, 63, 64, 65 a low-permittivity dielectric allowing metallized vias to be produced and optionally drilled may be used between the radiating elements 1 and the ground plane 24. Foams suitable for being metallized may also be used.

In another embodiment, in the case in particular where the two-wire lines are formed from pins, pins that supplement the two-wire lines may be added, in particular in antenna embodiments in which the layer 22 located between the radiating elements and the ground plane is a low-density foam that is not suitable for being metallized.

Figure 7:
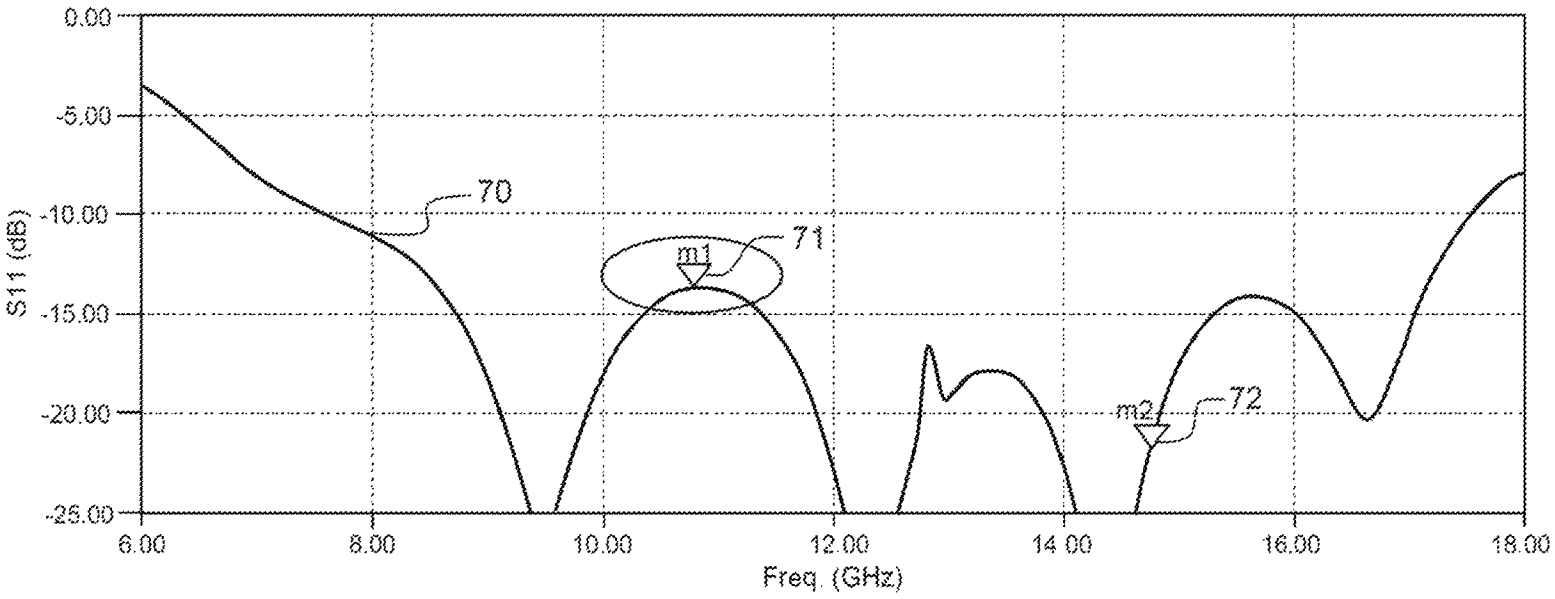
FIG. 7, an exemplary curve representative of the reflection coefficient of an antenna according to the invention.

FIG. 7 illustrates the improvement achieved by the array of vias, in the case where the vias are installed according to the embodiment in FIG. 5. As in FIG. 4, the reflection coefficient S11 has been shown as a function of frequency in the same range, between 6 and 16 GHz. The curve 40 representing the value of the reflection coefficient no longer contains the peaks 41, 42 of the curve 40 in FIG. 4. The points 71, 72 of the curve corresponding to the frequencies of the peaks 41, 42 are greatly attenuated, the high peaks having disappeared. By comparing the first curve 40 and the second curve 70, a clear improvement in the performance of the radiating surface 21, as regards the reflection coefficient, as a function of frequency, at incidence of 20 degrees in the exemplary application, may be seen.

The invention claimed is:

1. A multilayer antenna array comprising:

a radiating structure formed from an array of radiating elements forming self-complementary patterns, each radiating element including:

a plurality of electrical supply points distributed around a perimeter of the respective radiating element; and four particular points distributed around the perimeter of the respective radiating element between consecutive electrical supply points of the plurality of electrical supply points;

a ground plane;

a dielectric layer that separates said radiating structure from said ground plane; and an array of metallized vias passing through said dielectric layer between the radiating structure and the ground plane, each via being positioned facing a respective one of the four particular points of each radiating element.

2. The antenna as claimed in claim 1, wherein each of the four particular points are located halfway between the respective two consecutive electrical supply points.

3. The antenna as claimed in claim 1, wherein the vias are metallized holes produced in said layer.

4. The antenna as claimed in claim 1, wherein the vias take the form of pins.

5. The antenna as claimed in claim 1, wherein the radiating structure is a printed circuit, the radiating elements being printed metal patches.

6. The antenna as claimed in claim 1, wherein the radiating structure is covered with another dielectric layer, said other dielectric layer being covered with a radome.

7. The antenna as claimed in claim 1, wherein the antenna is able to operate in a wide frequency range, for multifunction applications.

* * * * *